US011147420B2

(12) United States Patent
Martinez

(10) Patent No.: US 11,147,420 B2
(45) Date of Patent: Oct. 19, 2021

(54) INFANT BATHING ASSEMBLY

(71) Applicant: Arnoldo Martinez, Los Angeles, CA (US)

(72) Inventor: Arnoldo Martinez, Los Angeles, CA (US)

( * ) Notice: Subject to any disclaimer, the term of this patent is extended or adjusted under 35 U.S.C. 154(b) by 0 days.

(21) Appl. No.: 16/807,772

(22) Filed: Mar. 3, 2020

(65) Prior Publication Data

US 2021/0274981 A1 Sep. 9, 2021

(51) Int. Cl.
*A47K 3/024* (2006.01)

(52) U.S. Cl.
CPC ..... *A47K 3/024* (2013.01)

(58) Field of Classification Search
CPC ... A47K 1/00; A47K 1/02; A47K 1/10; A47K 1/12; A47K 3/001; A47K 3/064; A47K 3/074; A47K 3/07; A47K 3/127; A47K 3/162; A47K 3/164; A47K 3/034; A47K 3/03; A47K 3/024; A47K 3/122; A47K 3/125; A47K 3/12; A47K 3/282
See application file for complete search history.

(56) References Cited

U.S. PATENT DOCUMENTS

| | | | | | |
|---|---|---|---|---|---|
| 594,900 | A | | 12/1897 | Palmer | |
| 1,335,446 | A | * | 3/1920 | McDaniel | A47K 1/02 248/292.12 |
| 1,724,479 | A | * | 8/1929 | Havener | A47K 3/074 4/550 |
| 1,846,492 | A | | 2/1932 | Johnson | |
| 1,883,660 | A | | 10/1932 | Feldman | |
| 2,719,306 | A | | 10/1955 | Levitt | |
| 3,094,711 | A | * | 6/1963 | Kentes | A47K 3/064 4/550 |
| 4,541,131 | A | * | 9/1985 | Sussman | A47K 3/281 211/113 |
| 4,837,871 | A | | 6/1989 | Wheeler | |
| 5,048,132 | A | | 9/1991 | Rizzo | |
| 5,067,186 | A | * | 11/1991 | Ayers | A47K 3/064 4/665 |
| 5,599,063 | A | * | 2/1997 | Lister | A47D 1/002 297/256.11 |
| 5,809,588 | A | | 9/1998 | Angelotti | |
| 5,974,601 | A | * | 11/1999 | Drane | A47K 3/001 4/539 |
| 7,305,724 | B2 | * | 12/2007 | Rozental | A47K 3/074 4/572.1 |
| 7,810,180 | B2 | | 10/2010 | List | |
| 9,179,805 | B1 | * | 11/2015 | Spratt-Anderson | A47K 3/282 |
| 10,952,576 | B2 | * | 3/2021 | Edwards | A47B 57/265 |
| 2011/0107511 | A1 | | 5/2011 | Alcala et al. | |

FOREIGN PATENT DOCUMENTS

| | | | | |
|---|---|---|---|---|
| AU | 274197 A | * | 4/1999 | A47K 3/125 |
| FR | 2926970 A1 | * | 8/2009 | A47K 3/281 |

* cited by examiner

*Primary Examiner* — Erin Deery

(57) ABSTRACT

An infant bathing assembly for bathing an infant includes a mounting unit that may be coupled to a vertical support surface. The mounting unit may have a shower head extended therethrough. A bathing unit is removably coupled to the mounting unit. The bathing unit may contain an infant thereby facilitating the infant to be bathed with the shower head.

9 Claims, 7 Drawing Sheets

INFANT BATHING ASSEMBLY

BACKGROUND OF THE DISCLOSURE

Field of the Disclosure

The disclosure relates to bathing devices and more particularly pertains to a new bathing device for bathing an infant.

SUMMARY OF THE DISCLOSURE

An embodiment of the disclosure meets the needs presented above by generally comprising a mounting unit that may be coupled to a vertical support surface. The mounting unit may have a shower head extended therethrough. A bathing unit is removably coupled to the mounting unit. The bathing unit may contain an infant thereby facilitating the infant to be bathed with the shower head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
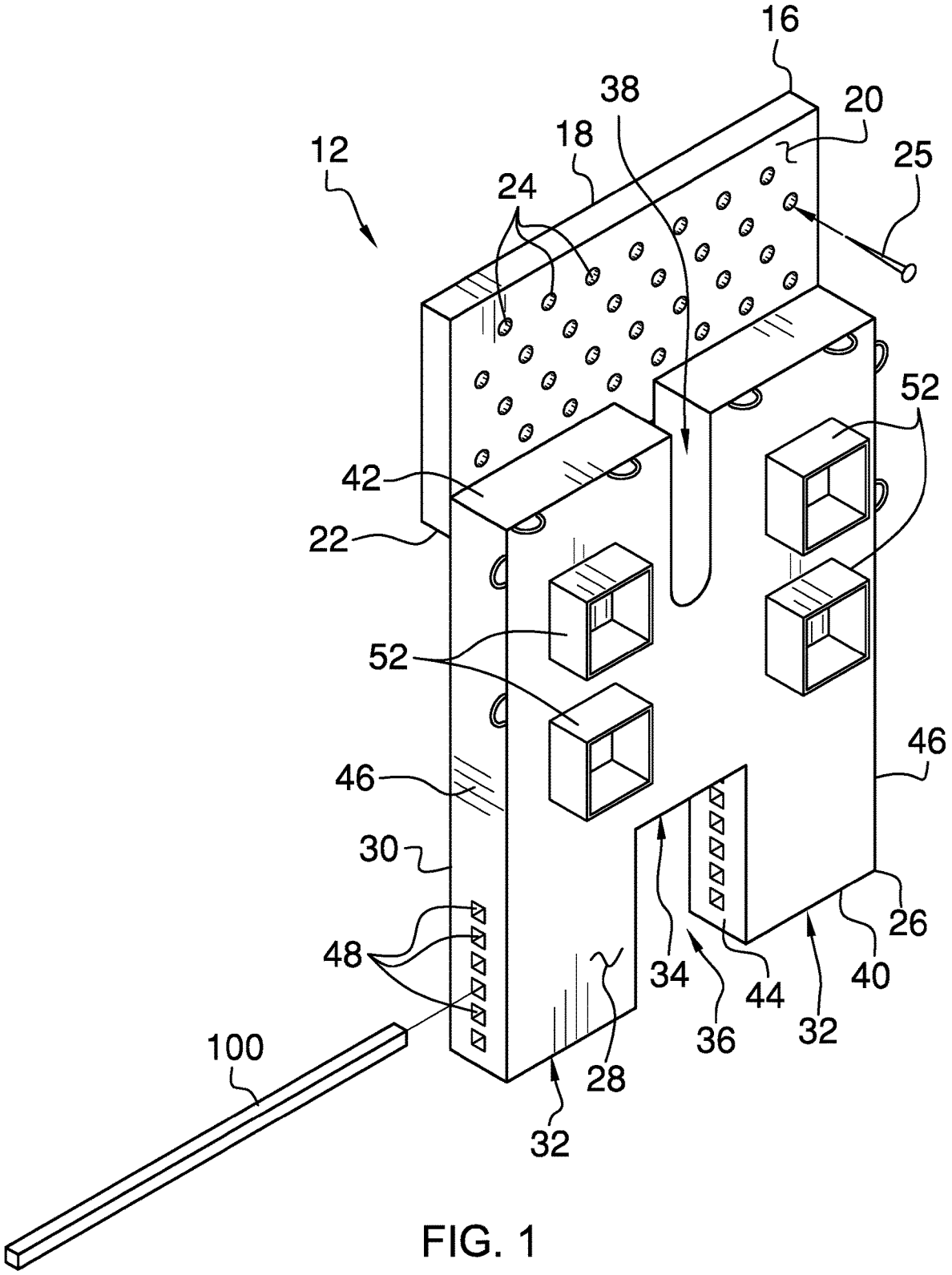
FIG. 1 is a perspective view of a mounting unit of an infant bathing assembly according to an embodiment of the disclosure.
Figure 2:
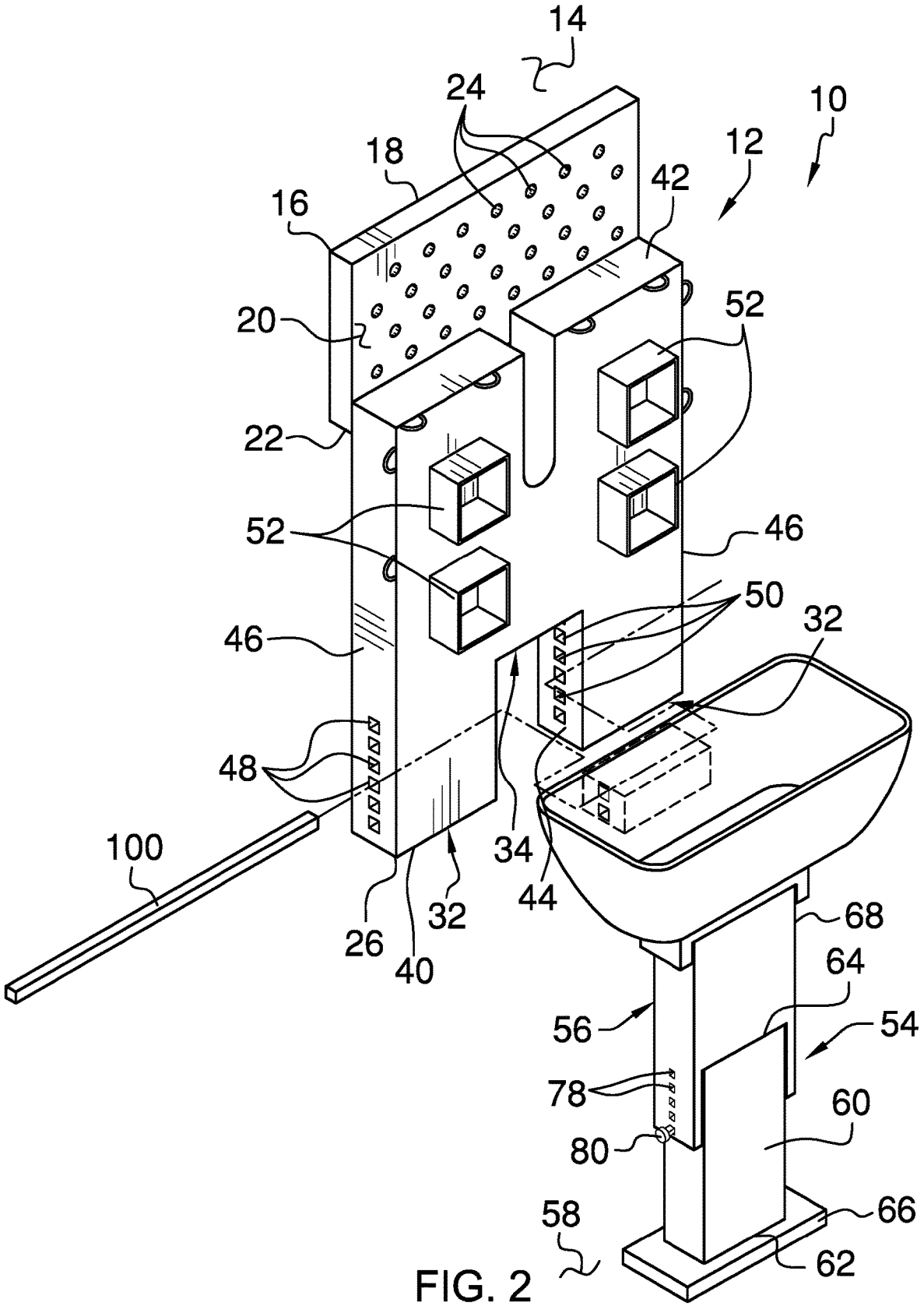
FIG. 2 is a front perspective view of an embodiment of the disclosure.
Figure 3:
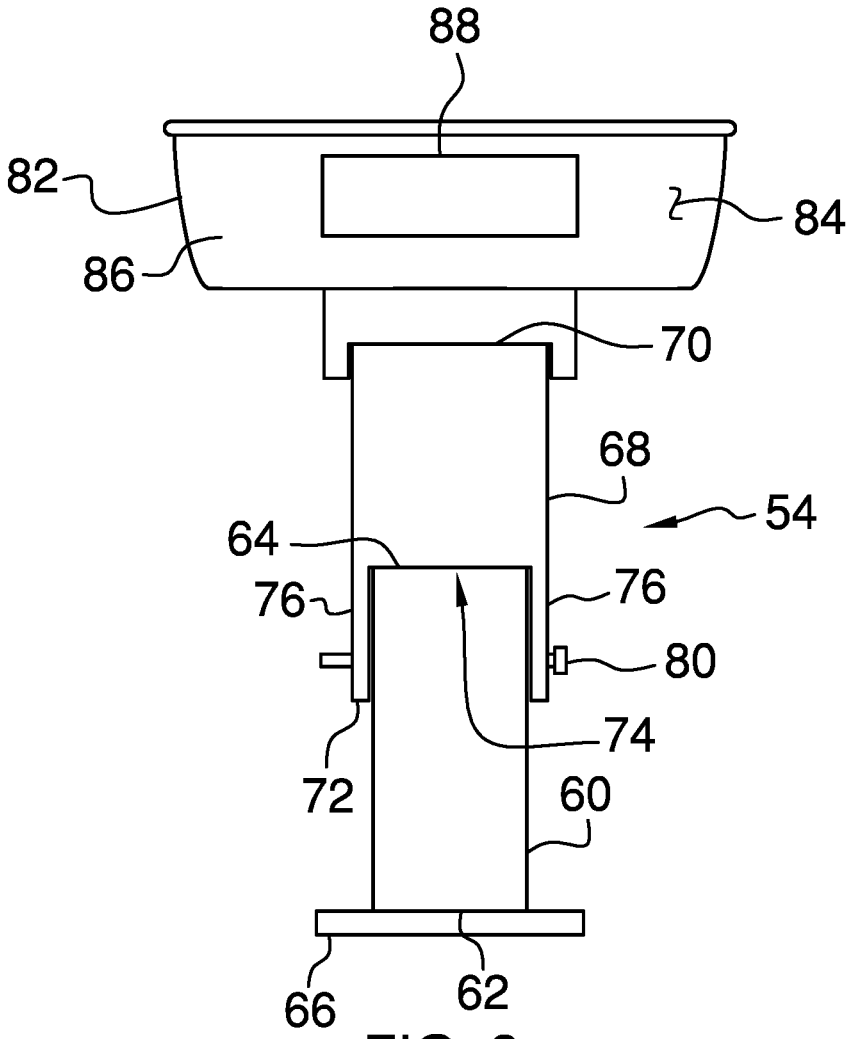
FIG. 3 is a back view of a bathing unit of an embodiment of the disclosure.
Figure 4:
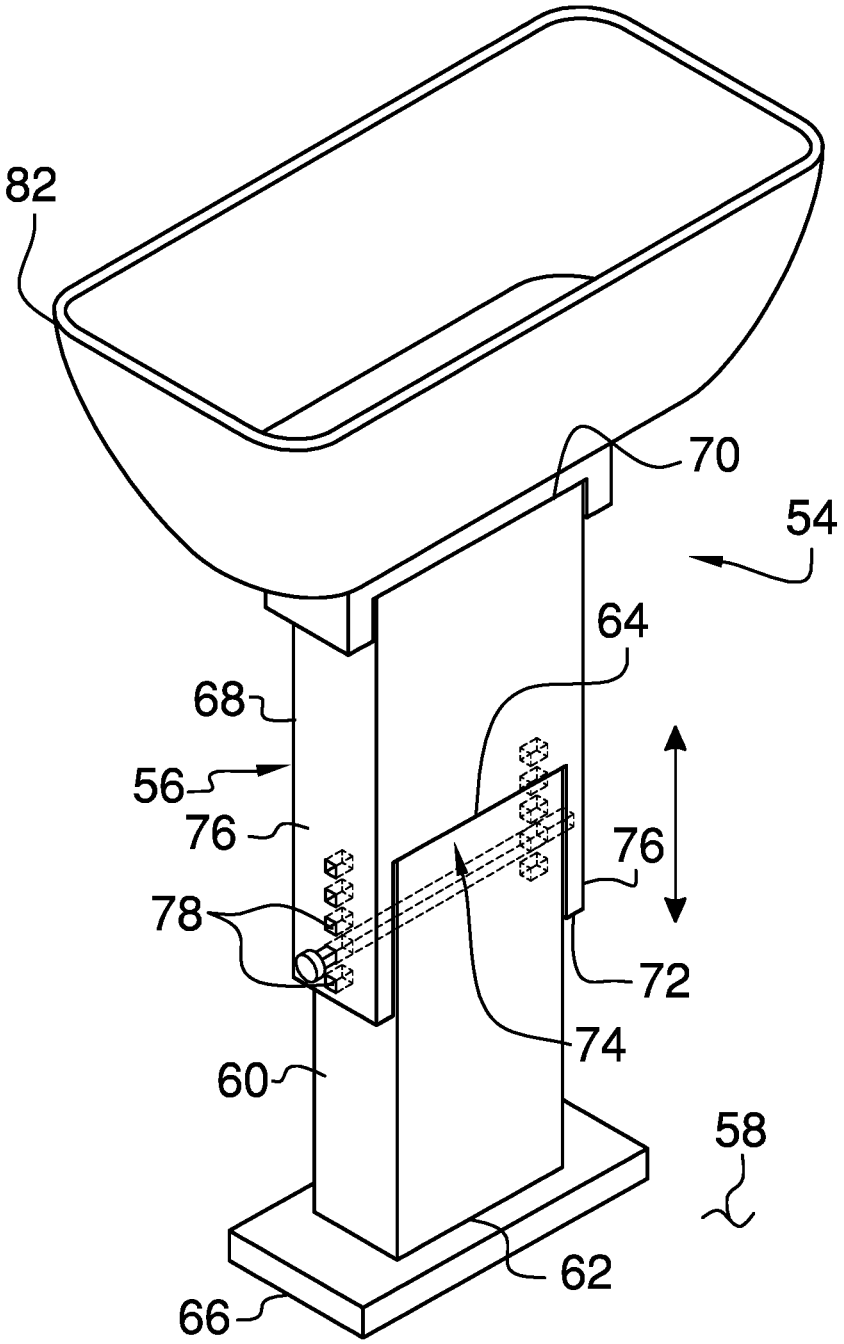
FIG. 4 is a front perspective view of a bathing unit of an embodiment of the disclosure.
Figure 5:
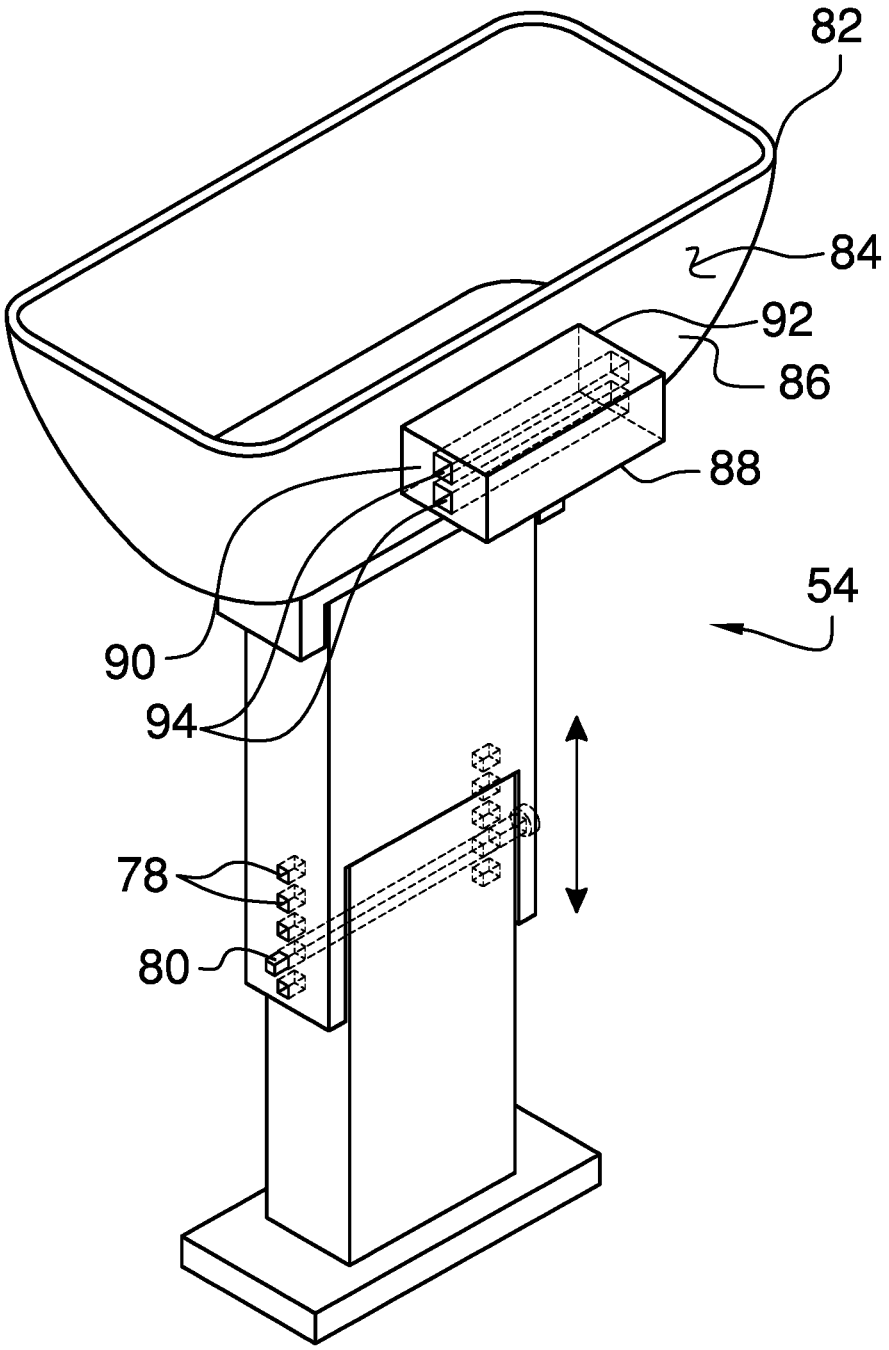
FIG. 5 is a back perspective view of a bathing unit of an embodiment of the disclosure.
Figure 6:
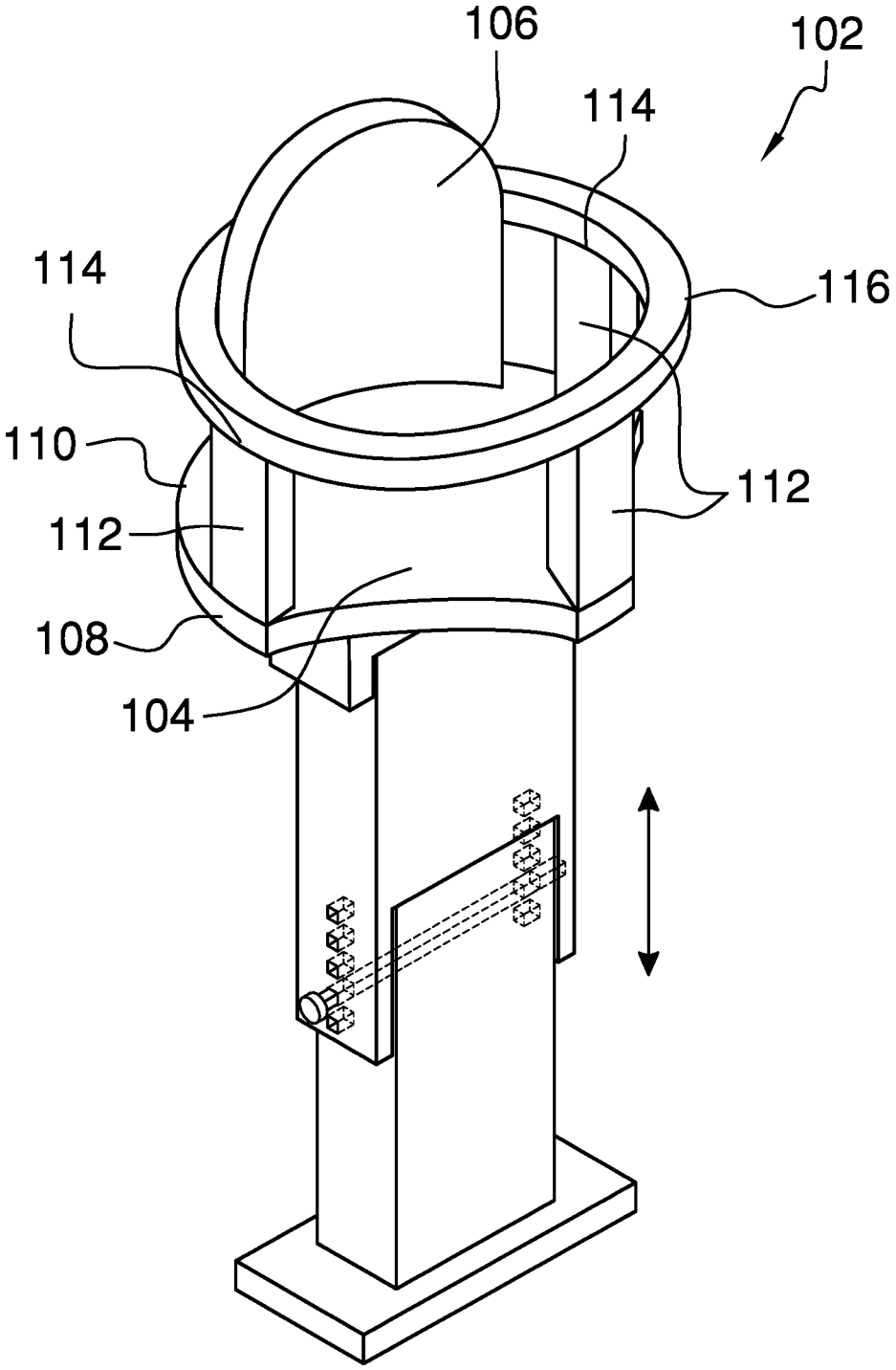
FIG. 6 is a front perspective view of chair of an embodiment of the disclosure.
Figure 7:
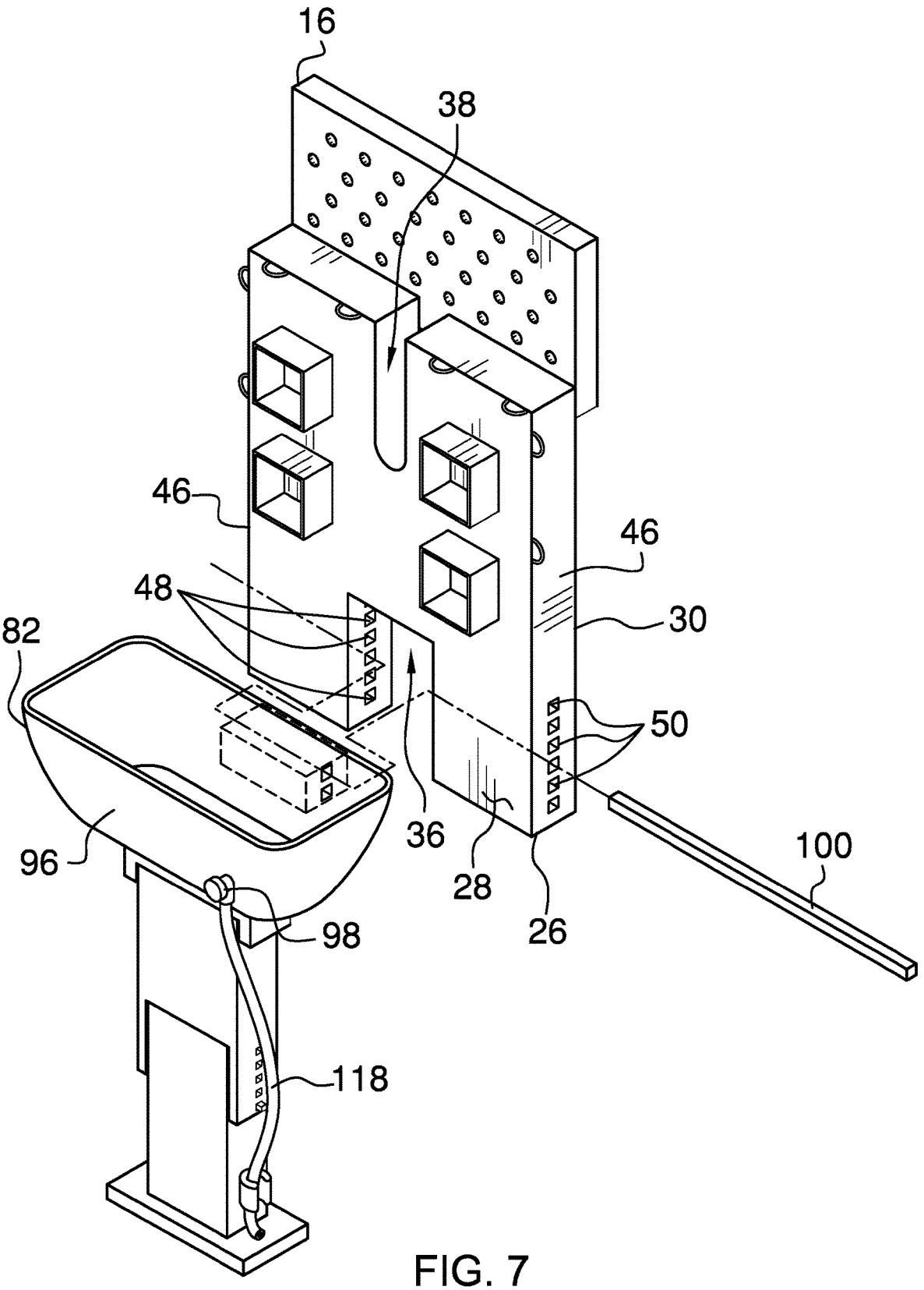
FIG. 7 is a perspective view of an embodiment of the disclosure.

With reference now to the drawings, and in particular to FIGS. 1 through 7 thereof, a new bathing device embodying the principles and concepts of an embodiment of the disclosure and generally designated by the reference numeral 10 will be described.

As best illustrated in FIGS. 1 through 7, the infant bathing assembly 10 generally comprises a mounting unit 12 that may be coupled to a vertical support surface 14. The mounting unit 12 may have a shower head extended therethrough. The vertical support surface 14 may be a wall in a bathroom or the like. The shower head may be a flexible shower head or the like.

The mounting unit 12 comprises a first panel 16 that has a first surface 18, a second surface 20 and a lower edge 22. The first surface 18 may be positioned to abut the vertical support surface 14. The first panel 16 has a plurality of apertures 24 extending through the first surface 18 and the second surface 20. The apertures 24 are spaced apart from each other and are distributed on the first panel 16. Thus, selected ones of the apertures 24 may be aligned with a structural support in the vertical support surface 14. At least one fastener 25 may be extended through the selected apertures 24 and engage the structural support. Thus, the first panel 16 may be retained on the vertical support surface 14.

A second panel 26 is provided that has a primary surface 28 and a secondary surface 30. The second panel 26 comprises a pair of lateral sections 32 and a central section 34 extending between the lateral sections 32. The lateral sections 32 are spaced apart from each other such that the second panel 26 has an H-shape. The lateral sections 32 define a first space 36 and a second space 38.

The first space 36 extends upwardly from a bottom edge 40 of the second panel 26. The second space 38 extends downwardly from a top edge 42 of the second panel 26. The first space 36 has a bounding edge 44 and each of the lateral sections 32 has an outwardly facing edge 46. The secondary surface 30 is coupled to the second surface 20 of the first panel 16. The top edge 42 of the panel is offset from the lower edge 22 of the first panel 16. The shower head may be extended through the second space 38.

The second panel 26 has a set of first openings 48. Each of the first openings 48 extends through the outwardly facing edge 46 of an associated one of the lateral sections 32 and the bounding edge 44 of the first space 36. The first openings 48 are spaced apart from each other and distributed along the associated lateral section 32. The second panel 26 has a set of second openings 50 extending through the outwardly facing edge 46 of an associated one of the lateral sections 32 and the bounding edge 44 of the first space 36. Each of the second openings 50 is aligned with an associated one of the first openings 48.

A plurality of boxes 52 is provided. Each of the boxes 52 is coupled to and extends away from the primary surface 28 of the second panel 26. Thus, each of the boxes 52 may contain objects. The objects may be soap, shampoo and other objects associated with bathing an infant. The boxes 52 are spaced apart from each other and are distributed on the second panel 26.

A bathing unit 54 is provided. The bathing unit 54 is removably coupled to the mounting unit 12. Thus, the bathing unit 54 may contain an infant thereby facilitating the infant to be bathed with the shower head. The bathing unit 54 comprises a stand 56. The stand 56 may be positioned on a support surface 58 having the stand 56 extending upwardly from the support surface 58. The support surface 58 may be a floor or the like.

The stand 56 comprises a bottom section 60 that may be positioned on the support surface 58. The bottom section 60 has a lowermost end 62 and an uppermost end 64. A base 66 may be coupled to the lowermost end 62. The base 66 may abut the support surface 58.

A top section 68 is provided that has a top end 70 and a bottom end 72. The bottom end 72 has a slot 74 extending upwardly toward the top end 70 to define a pair of legs 76. The legs 76 are spaced apart from each other. Each of the legs 76 has a plurality of third openings 78 extending into the slot 74. The third openings 78 are spaced apart from each other and are vertically distributed on each of the legs 76. The third openings 78 on each of the legs 76 are complementary with each other. The uppermost end 64 of the bottom section 60 is positioned in the slot 74.

A first rod 80 is selectively inserted through an associated pair of the third openings 78 and engaging the bottom section 60. Thus, the stand 56 has a selectively adjustable height. A bowl 82 is removably coupled to the top end 70 of the top section 68. The infant may be positioned in the bowl 82 thereby facilitating the infant to be bathed. The bowl 82 has an outer surface 84 and the outer surface 84 has a first side 86.

A block 88 is coupled to the first side 86 of the bowl 82. The block 88 has a first lateral side 90 and a second lateral side 92. The block 88 has a pair of fourth openings 94 extending through the first lateral side 90 and the second lateral side 92. The block 88 is positioned in the first space 36 in the second panel 26. The pair of fourth openings 94 is aligned with selected ones of the first openings 48 and the second openings 50 in the second panel 26.

The bowl 82 has a second side 96 and a drain 98 extends through the second side 96. A tube 118 is fluidly coupled to the drain 98. Thus, the drain 98 may drain 98 a fluid from the bowl 82. The fluid may be water or the like.

A second rod 100 is provided. The second rod 100 is inserted through a selected one of the first openings 48 and an associated one of the second openings 50. The second rod 100 extends through a selected one of the fourth openings 94 in the block 88. Thus, the bathing unit 54 is removably coupled to the mounting unit 12.

A chair 102 is provided. The chair 102 has a seat 104 and a back rest 106 extending upwardly from the seat 104. The seat 104 has a perimeter edge 108 and the perimeter edge 108 has a curved section 110. The back rest 106 is aligned with the curved section 110. Moreover, the perimeter edge 108 tapers to a point.

A plurality of uprights 112 is coupled to and extends upwardly from the seat 104. The uprights 112 are spaced apart from each other and distributed around the seat 104. Each of the uprights 112 has a distal end 114 with respect to the seat 104. A ring 116 is provided and the ring 116 is coupled to the distal end 114 of each upright. The chair 102 is removably positioned on the top end 70 of the top section 68 corresponding to the stand 56. The infant may be positioned in the chair 102 to be bathed.

In use, the mounting unit 12 is placed on the vertical support surface 14. The at least one fastener 25 is extended through selected apertures 24 in the first panel 16. Thus, the at least one fastener 25 engages a structural support in the vertical support surface 14. The shower head is extended through the second space 38 in the second panel 26.

The first rod 80 is extended through the selected pair of third openings 78. Thus, the stand 56 is retained at a selected height. The block 88 is positioned in the first space 36. The pair of fourth openings 94 is aligned with a complementary pair of first 48 and second 50 openings. The second rod 100 is extended through the complementary pair of first 48 and second 50 openings and engages the block 88. Thus, the bowl 82 is coupled to the second panel 26. The infant is positioned in the bowl 82 and the infant is bathed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An infant bathing assembly comprising:

a mounting unit being configured to be coupled to a vertical support surface, said mounting unit being configured to have a shower head extended therethrough, wherein said mounting unit comprises a first panel having a first surface, a second surface and a lower edge, said first surface being configured to abut the vertical support surface, said first panel having a plurality of apertures extending through said first surface and said second surface, said apertures being spaced apart from each other and distributed on said first panel wherein selected ones of said plurality of apertures are configured to be aligned with a structural support in the vertical support surface thereby facilitating a fastener to be extended through said selected ones of said plurality of apertures and engage the structural support, wherein said first panel is configured to be retained on the vertical support surface, a second panel having a primary surface and a secondary surface, said second panel comprising a pair of lateral sections and a central section extending between said lateral sections, said lateral sections being spaced apart from each other such that said second panel has an H-shape, said lateral sections defining a first space and a second space, said first space extending upwardly from a bottom edge of said second panel, said second space extending downwardly from a top edge of said second panel, said first space having a bounding edge, each of said lateral sections having an outwardly facing edge, said secondary surface being coupled to said second surface of said first panel, said top edge of said second panel being offset from said lower edge of said first panel, said second space being configured to have the shower head extended therethrough, said second panel having a set of first openings extending through said outwardly facing edge of a first lateral section of said pair of lateral sections and said bounding edge of said first space, said first openings being spaced apart from each other and distributed along said first lateral section, said second panel having a set of second openings extending through said outwardly facing edge of a second lateral section of said pair of lateral sections and said bounding edge of said first space, each second opening of said set of second openings being aligned with an associated first opening of said set of first openings; and a bathing unit being removably coupled to said mounting unit wherein said bathing unit is configured to contain an infant thereby facilitating the infant to be bathed with the shower head.

2. The assembly according to claim 1, further comprising a plurality of boxes, each box of said plurality of boxes being coupled to and A extending away from said primary surface of said second panel, wherein each box of said plurality of boxes is configured to contain objects, said plurality of boxes being spaced apart from each other and being distributed on said second panel.

3. The assembly according to claim 1, wherein said bathing unit comprises a stand being configured to be positioned on a support surface having said stand extending upwardly from the support surface.

4. The assembly according to claim 3, wherein said stand comprises:

a bottom section being configured to be positioned on the support surface; and a top section having a top end and a bottom end, said bottom end having a slot extending upwardly toward said top end to define a pair of legs, each leg being spaced apart from each other, each leg of said pair of legs having a plurality of third openings extending into said slot, said third openings of said plurality of third openings being spaced apart from each other and being vertically distributed on each leg of said pair of legs, said third openings of said plurality of third openings on each leg of said air legs being complementary with each other, said bottom section being positioned in said slot.

5. The assembly according to claim 4, further comprising a first rod being selectively inserted through an associated pair of third openings of said plurality of third openings and engaging said bottom section such that said stand has a selectively adjustable height.

6. The assembly according to claim 4, further comprising a bowl being coupled to said top end of said top section wherein said bowl is configured to have the infant positioned therein, said bowl having an outer surface, said outer surface having a first side.

7. An infant bathing assembly comprising:

a mounting unit being configured to be coupled to a vertical support surface, said mounting unit being configured to have a shower head extended therethrough;

a bathing unit being removably coupled to said mounting unit wherein said bathing unit is configured to contain an infant thereby facilitating the infant to be bathed with the shower head, said bathing unit comprising a stand being configured to be positioned on a support surface having said stand extending upwardly from the support surface, wherein said stand comprises a bottom section being configured to be positioned on the support surface, and a top section having a top end and a bottom end, said bottom end having a slot extending upwardly toward said top end to define a pair of legs, each leg being spaced apart from each other, each leg of said pair of legs having a plurality of third openings extending into said slot, said third openings of said plurality of third openings being spaced apart from each other and being vertically distributed on each leg of said pair of legs, said third openings of said plurality of third openings on each leg of said pair legs being complementary with each other, said bottom section being positioned in said slot;

a bowl being coupled to said top end of said top section wherein said bowl is configured to have the infant positioned therein, said bowl having an outer surface, said outer surface having a first side;

a second panel having a first space, a plurality of first openings and a plurality of second openings; and a block being coupled to said first side of said outer surface, said block having a first lateral side and a second lateral side, said block having a pair of fourth openings extending through said first lateral side and said second lateral side, said block being positioned in said first space in said second panel having said pair of fourth openings being aligned with selected first openings of said plurality of first openings and second openings of said plurality of second openings in said second panel.

8. The assembly according to claim 7, further comprising a second rod being inserted through one of the selected first openings and second openings, and having said second rod extending through a selected one of said fourth openings in said block such that said bathing unit is removably coupled to said mounting unit.

9. An infant bathing assembly comprising:

a mounting unit being configured to be coupled to a vertical support surface, said mounting unit being configured to have a shower head extended therethrough, said mounting unit comprising:

a first panel having a first surface, a second surface and a lower edge, said first surface being configured to abut the vertical support surface, said first panel having a plurality of apertures extending through said first surface and said second surface, said apertures of said plurality of apertures being spaced apart from each other and distributed on said first panel wherein selected apertures of said plurality of apertures are configured to be aligned with a structural support in the vertical support surface thereby facilitating a fastener to be extended through said selected aperture of said plurality of apertures and engage the structural support, wherein said first panel is configured to be retained on the vertical support surface, a second panel having a primary surface and a secondary surface, said second panel comprising a pair of lateral sections and a central section extending between said lateral sections, said lateral sections being spaced apart from each other such that said second panel has an H-shape, said lateral sections defining a first space and a second space, said first space extending upwardly from a bottom edge of said second panel, said second space extending downwardly from a top edge of said second panel, said first space having a bounding edge, each lateral section of said pair of lateral sections having an outwardly facing edge, said secondary surface being coupled to said second surface of said first panel, said top edge of said second panel being offset from said lower edge of said first panel, said second space being configured to have the shower head extended therethrough, said second panel having a set of first openings extending through said outwardly facing edge of a first lateral section of said pair of lateral sections and said bounding edge of said first space, said first openings of said plurality of first openings being spaced apart from each other and distributed along said first lateral section, said second panel having a set of second openings extending through said outwardly facing edge of a second lateral section of said pair of lateral sections and said bounding edge of said first space, each second opening of said plurality of second openings being aligned with an associated first opening of said plurality of first openings, and a plurality of boxes, each box of said plurality of boxes being coupled to and extending away from said primary surface of said second panel, wherein each box of said plurality of boxes is configured to contain objects, said boxes of said plurality of boxes being spaced apart from each other and being distributed on said second panel; and a bathing unit being removably coupled to said mounting unit wherein said bathing unit is configured to contain an infant thereby facilitating the infant to be bathed with the shower head, said bathing unit comprising:

a stand being configured to be positioned on a support surface having said stand extending upwardly from the support surface, said stand comprising:

a bottom section being configured to be positioned on the support surface, a top section having a top end and a bottom end, said bottom end having a slot extending upwardly toward said top end to define a pair of legs, each leg being spaced apart from each other, each leg of said pair of legs having a plurality of third openings extending into said slot, said third openings being spaced apart from each other and being vertically distributed on each leg of said pair of legs, said third openings on each leg of said pair of legs being complementary with each other, said bottom section being positioned in said slot, and a first rod being selectively inserted through an associated pair of said third openings and engaging said bottom section such that said stand has a selectively adjustable height, and a bowl being coupled to said top end of said top section wherein said bowl is configured to have the infant positioned therein, said bowl having an outer surface, said outer surface having a first side, a block being coupled to said first side of said outer surface, said block having a first lateral side and a second lateral side, said block having a pair of fourth openings extending through said first lateral side and said second lateral side, said block being positioned in said first space in said second panel having said pair of fourth openings being aligned with selected ones of said first openings and said second openings in said second panel, and a second rod being inserted through one of the selected first openings and second openings, and having said second rod extending through a selected one of said fourth openings in said block such that said bathing unit is removably coupled to said mounting unit.

* * * * *